US008876595B2

(12) United States Patent
Nelson et al.

(10) Patent No.: US 8,876,595 B2
(45) Date of Patent: Nov. 4, 2014

(54) MOBILE DEVICE TO SECURITY EVENT ASSOCIATION IN GAMING ENVIRONMENTS

(75) Inventors: Dwayne R. Nelson, Las Vegas, NV (US); Steven G. LeMay, Reno, NV (US); Derrick Price, Las Vegas, NV (US)

(73) Assignee: IGT, Las Vegas, NV (US)

( * ) Notice: Subject to any disclaimer, the term of this patent is extended or adjusted under 35 U.S.C. 154(b) by 467 days.

(21) Appl. No.: 13/361,601

(22) Filed: Jan. 30, 2012

(65) Prior Publication Data

US 2013/0196755 A1 Aug. 1, 2013

(51) Int. Cl.
*G07F 17/32* (2006.01)
*A63F 9/24* (2006.01)

(52) U.S. Cl.
USPC ..... 463/29

(58) Field of Classification Search
CPC ..... G07F 17/3241
USPC ..... 463/11–13, 17–19, 16, 20, 25, 26–28, 463/30, 31, 40–42, 29, 39; 340/506
See application file for complete search history.

(56) References Cited

U.S. PATENT DOCUMENTS 5,611,730 A * 3/1997 Weiss ..... 463/20
7,201,660 B2 * 4/2007 Kiely et al. ..... 463/42

* cited by examiner

*Primary Examiner* — David L Lewis
*Assistant Examiner* — Matthew D Hoel
(74) *Attorney, Agent, or Firm* — Foley & Lardner LLP

(57) ABSTRACT

A system that tracks information related to security events in a gaming environment includes a plurality of gaming machines, a database storing data regarding security events, and a security event tracking server in communication with the gaming machines and database. Each gaming machine can have an electronic tracking device adapted to detect wirelessly identifying information from portable electronic devices proximate the gaming machine with respect to the occurrence of a security event at or near the gaming machine. The server includes a processor configured to receive information regarding security events and mobile device identifying information, associate the security events with the identifying information, and store the associated security events and identifying information to the database. Mobile device identifying information can be detected passively without any affirmative input by any user of the mobile devices. Patterns of repeated mobile device detections associated with multiple security events can be determined.

20 Claims, 8 Drawing Sheets

MOBILE DEVICE TO SECURITY EVENT ASSOCIATION IN GAMING ENVIRONMENTS

TECHNICAL FIELD

The present invention relates generally to gaming machines and systems, and more particularly to tracking information associated with security events within a gaming enterprise.

BACKGROUND

The electronic gaming machine ("EGM") has mostly supplanted the traditional mechanically driven reel slot machine in recent years. Processor-based gaming machines have become the norm, due in part to the nearly endless variety of games and operator benefits that can be implemented using processor-based technology. Such processor-based gaming machines or EGMs permit the use of more complex games, advanced player tracking, improved security, cashless gaming, and wireless communications, and also add a host of other digital features that are just not possible on purely mechanical gaming machines.

Because casinos and other gaming establishments that utilize such EGMs comprise a multi-billion dollar industry where large sums of money or monetary credits can quickly change hands during many types of fast paced games, such gaming establishments are a prime target for cheating, stealing and other questionable activities. As such, the use of surveillance systems and other security measures are prevalent in the gaming industry. Examples of such systems and measures can be found in, for example, U.S. Pat. Nos. 5,111,288; 5,258,837; 5,872,594; 6,166,763; and 7,525,570, all of which are incorporated herein by reference in their entirety. Many other examples of similar security systems and measures are also available, as will be readily appreciated, and such systems and measures can often apply to other environments outside of a gaming context.

Despite many advanced and extensive features, however, there are still various drawbacks to even the most modern security systems. For example, there can sometimes be more cameras than monitors or personnel available to review the numerous monitors in a given system. In addition, many cameras can be assigned to multiple areas or views, and some areas may be excluded from camera view entirely, such that it is not possible for a camera to monitor or record every possible view at all times. Furthermore, surveillance operators are often required to examine or monitor a substantial number of camera views or areas manually on a periodic basis, but high workloads and the substantial number of views required can render such a task as difficult or impossible even for a proficient operator. Manual review duties can also be further compromised by actual security events or alarms, whereby one or more operators abandon any normal surveying activities to respond to a security event.

As such, current security systems and methods can be labor intensive and thus costly, and can also introduce a wide variety of human-related errors, such as inattentiveness, slowness, and the inherent inability to see and process all things at all times. Although some advances have been made in the field of automated video surveillance and overall security in general, such as those disclosed in the references listed above, such systems can be unreliable and still tend to require a high degree of manual intervention.

While many designs and techniques used to provide security in a gaming establishment have generally worked well in the past, there is always a desire to provide further devices and techniques to allow for the gathering of additional data that may be relevant to actual security events in a gaming environment.

SUMMARY

It is an advantage of the present invention to provide devices and techniques beyond traditional camera based systems that allow for the gathering of data that may be relevant to actual security events in a gaming environment. Such devices and techniques can provide a way to determine which people are around an EGM or other floor location when a security event happens, which can be useful for auditing and security purposes. This can be accomplished at least in part through the use of a network of components that can detect and track the presence of one or more portable electronic devices near security events when they happen. Such components can be installed into various EGMs and other casino devices, and long term tracking of mobile devices associated with security events can indicate patterns or trends with respect to potential suspicious activities by specific third parties.

In various embodiments of the present invention, systems adapted to facilitate the tracking of information related to security events in a gaming environment are provided. Such systems can include a plurality of gaming machines, a database adapted to store a plurality of informational files regarding security events, and a security event tracking server in communication with the plurality of gaming machines and the database. Each of the gaming machines can include a master gaming controller adapted to execute or control one or more aspects of a wager-based game, a communication interface adapted to facilitate communications between the gaming machine and an external remote server, and an electronic tracking device adapted to detect wirelessly identifying information from one or more portable electronic devices proximate to the gaming machine with respect to the occurrence of a security event at or near the gaming machine. The database can store data regarding security events and detected portable electronic devices associated therewith that are detected by one or more of the plurality of gaming machines. The security event tracking server can include a processor, a memory and a network interface. In particular, the processor can be configured to receive information regarding a security event and identifying information regarding one or more portable electronic devices from one or more of the plurality of gaming machines, associate the security event with the portable electronic device identifying information, and store the associated security event and portable electronic device identifying information to the database.

In various detailed embodiments of the present invention, the server processor is further configured to provide commands to one or more of the plurality of gaming machines to transmit a wireless signal to determine the presence of one or more portable electronic devices. Such commands can be in response to receiving a notice of the existence of a security event, and/or can be provided at regular periodic intervals regardless of the existence of a security event. In some embodiments, the processor is further configured to utilize passively detected identifying information regarding one or more portable electronic devices from a plurality of gaming machines to establish the actual relative locations of each of the one or more portable electronic devices at a given time. In addition, the processor can be further configured to detect repeat instances of the same portable electronic device in association with different security events. Also, the processor can provide an alert with respect to said same portable electronic device when the number of repeat instances reaches a threshold value.

In various embodiments, the portable electronic device identifying information can be detected passively without any affirmative input by any user of the one or more portable electronic devices. The various portable electronic devices can include, for example, a PDA, cell phone, tablet computer, laptop, netbook, headset, and/or media player, among other possible suitable devices. Further, the security events can include, for example, an opened door, turned security switch, monetary drop access, device tilt, power down, machine reconfiguration, maintenance work, game download, game selection change, ticket-in, ticket-out, jackpot win, and player tracking event, among other possible suitable security events.

In various additional embodiments, a processor-based gaming machine is provided. Such a gaming machine can be identical or substantially similar to that which is provided for the system above. Such a gaming machine in isolation can be adapted to interact with a remote server as in the case of the system gaming machine above, as will be readily appreciated.

In still further embodiments, various methods of tracking data regarding security events involving processor-based gaming machines are provided. As in all embodiments, the processor-based gaming machines can include machines that are adapted for accepting monetary wagers, playing games based on the wagers and granting payouts based on the results of the wager-based games. Various process steps can include detecting the existence of a security event at or near a processor-based gaming machine, transmitting a wireless signal from the processor-based gaming machine, collecting identifying information wirelessly from a portable electronic device at the processor-based gaming machine in response to said transmitted signal, providing data regarding the first security event and the identifying information for the first portable electronic device from the processor-based gaming machine to a remotely located server, and recording said data in a manner that associates the security event with the identifying information for the portable electronic device. Again, the collecting step can be performed passively without any affirmative input by the user of a portable electronic device.

Additional process steps can include, for example, maintaining a database of recorded information that includes a plurality of known security events and a plurality of detected portable electronic devices associated with said known security events, and/or collecting identifying information wirelessly from one or more additional and separate portable electronic devices at the processor-based gaming machine in response to said transmitted signal, with such information also being communicated to and acted upon by the remote server.

In various embodiments, the step of transmitting can be performed in response to the step of detecting. Alternatively, or in addition, the step of transmitting can be performed at periodic intervals regardless of the existence of a security event. In some of the embodiments, each of the recited steps are repeated for the occurrence of a separate second security event. Repetition for further security events is also possible. In addition, various embodiments can include transmitting a wireless signal from one or more additional processor-based gaming machines that may be near the first processor-based gaming machine. Similar process steps relating to collecting, transmitting, storing and acting upon additional information from these one or more additional gaming machines may also be performed.

Other apparatuses, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and arrangements for the disclosed inventive apparatuses and methods for tracking and analyzing data associated with security events in a gaming environment. These drawings in no way limit any changes in form and detail that may be made to the invention by one skilled in the art without departing from the spirit and scope of the invention.

DETAILED DESCRIPTION

Exemplary applications of apparatuses and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as limiting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting; such that other embodiments may be used, and changes may be made without departing from the spirit and scope of the invention.

The present invention relates in various embodiments to tracking information associated with security events within a gaming enterprise. Such security related information can include the mere presence of mobile devices at or near the location where a security event takes place. Such mobile devices can include those that are issued by or associated with the gaming establishment, and can also include other third party mobile devices that may have been previously unknown as well. Tracking, storage and analysis of culled security event related data can be made by way of one or more server or system components that are specially adapted for such a purpose. The detection of various security event associated mobile devices can be accomplished by particular hardware items installed on or about EGMs, other devices or elsewhere about a gaming establishment.

EGMs or devices for use with the present invention can be, for example, any of the processor based gaming machines provided by IGT of Reno, Nev., or any other gaming machine or system provider. Although the subject gaming machines and systems can be adapted to provide a wager based game of chance by displaying video data that simulates a mechanical reel, it will be readily appreciated that the various embodiments of the present invention disclosed herein can also be used with gaming machines that provide or simulate wheels, cards, bingo items, keno items, racing icons, sporting icons and a wide variety of other gaming items. Further, the present invention can also be used in some instances in conjunction with other machines and items that are not limited to processor based or wager based games. For example, purely mechanical gaming machines or gaming machines adapted to provide games that are not wager based can also be used.

Gaming Machines and Systems

Figure 1:
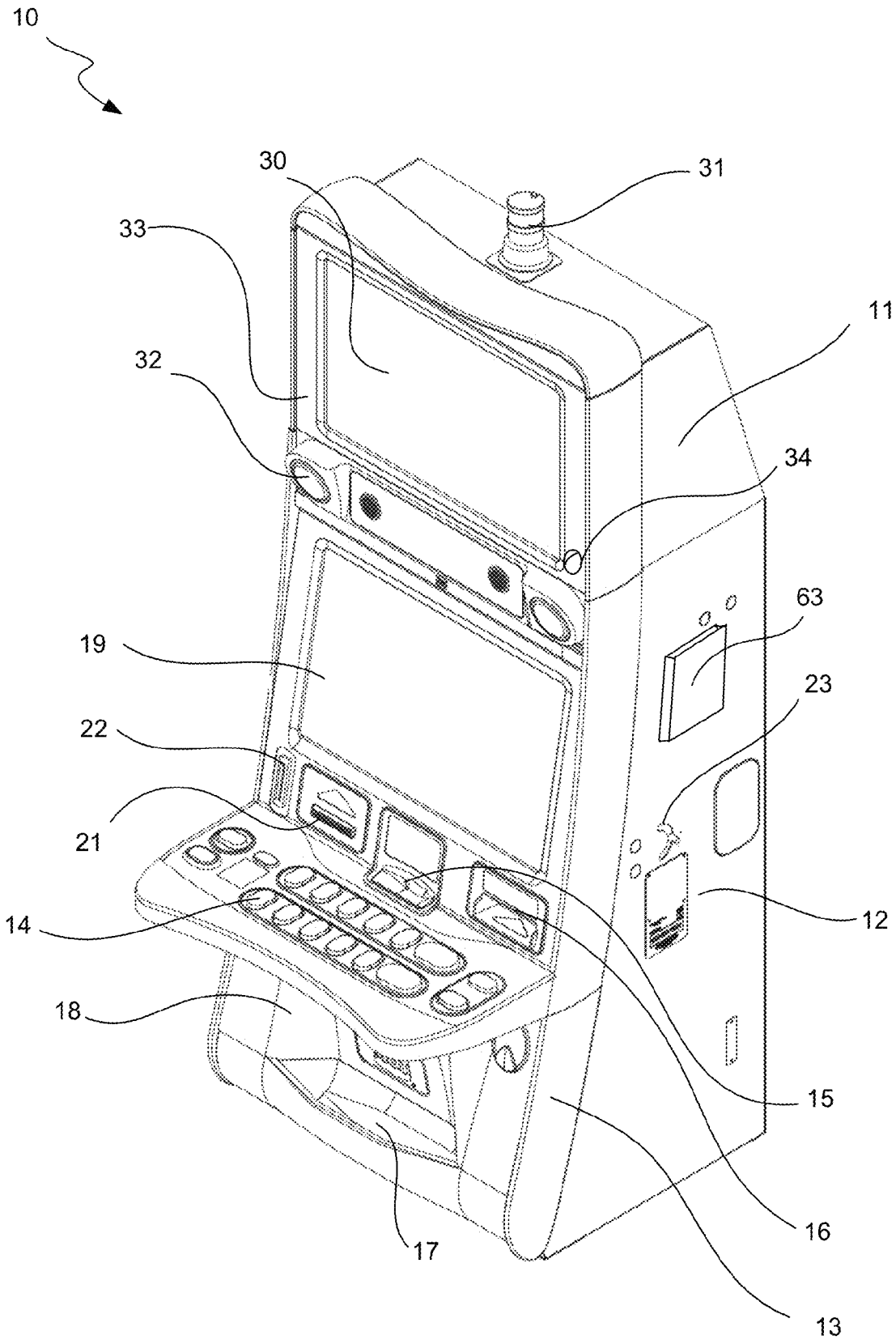
FIG. 1 illustrates in front perspective view an exemplary gaming machine adapted for mobile device data tracking according to one embodiment of the present invention.

Referring first to FIG. 1, one example of a processor based gaming machine in is shown in front perspective view. Gaming machine 10 is one example of what can be considered a "thick-client" device. Typically, a thick-client device is configurable to communicate with one or more remote servers, but provides game play independent of the remote servers. Such independent game play can include game outcome determination, for example. In addition, a thick-client device can be considered as such because it includes cash handling capabilities, such as peripheral devices for receiving cash, and a secure enclosure within the device for storing the received cash. In contrast, a thin-client device, such as a mobile gaming device, may be more dependent on a remote server to provide a component of the game play on the device, such as game outcome determination, and/or may not include peripheral devices for receiving and securely storing cash.

Many different configurations are possible between thick and thin clients. For instance, a thick-client device, such as gaming machine 10, deployed in a central determination configuration, may receive game outcomes from a remote server but still provide cash handling capabilities. Further, the peripheral devices can vary from gaming device to gaming device. For instance, gaming machine 10 can be configured with electro-mechanical reels to display a game outcome instead of a video display. Thus, the various features and peripherals of gaming machine 10 are described for the purposes of illustration only, and are not meant to be limiting. One of skill in the art will readily appreciate numerous other peripherals and differences not set forth herein.

As shown, gaming machine 10 can include a top box 11 and a main cabinet 12, which defines an interior region of the gaming machine. The cabinet includes one or more rigid materials to separate the machine interior from the external environment, is adapted to house a plurality of gaming machine components within or about the machine interior, and generally forms the outer appearance of the gaming machine. Main cabinet 12 includes a main door 13 on the front of the machine, which opens to provide access to the interior of the machine. The interior may include any number of internal compartments, such as for cooling and security purposes, among others. Attached to the main door or cabinet are typically one or more player-input switches or buttons 14; one or more money or credit acceptors, such as a coin acceptor 15, and a bill or ticket scanner and acceptor 16; a coin tray 17; and a belly glass 18. Viewable through main door 13 is a primary display monitor 19.

Top box 11, which typically rests atop of the main cabinet 12, may also contain one or more secondary or additional displays 30, a candle 31, one or more speakers 32, a top glass 33 and a camera 34, among other items. Various further gaming machine items can be located on the top box and/or main cabinet. For example, main cabinet 12 may also include a ticket printer 21, a card reader 22, and a locking mechanism 23 for main door 13, among other items. One or more of these components can be used to form a player tracking device, as will be readily appreciated. For example, card reader 22 can be part of a player tracking device that is integrated within the machine. One or more additional player tracking displays (not shown) may also be used in conjunction with these and/or other components. In addition, a mobile device tracking or communications unit 63 can also be placed on or about gaming machine 10. Such a device can be adapted to communicate with or simply detect data from third party mobile devices, as set forth in greater detail below. Further components and combinations are also possible, as is the ability of the top box to contain one or more items traditionally reserved for main cabinet locations, and vice versa. For example, the ticket printer or various integrated player tracking components may be located on the top box for some gaming machines.

It will be readily understood that gaming machine 10 can be adapted for presenting and playing any of a number of games and gaming events, particularly games of chance involving a player wager and potential monetary payout, such as, for example, a digital slot machine game and/or any other video reel game, among others. While gaming machine 10 is usually adapted for live game play with a physically present player, it is also contemplated that such a gaming machine may also be adapted for remote game play with a player at a remote gaming terminal. Such an adaptation preferably involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or other "thin" gaming terminal, in that all processing may be done at a remote server, with only the external housing, displays, and pertinent inputs and outputs being available to a player. Further, it is also worth noting that the term "gaming machine" may also refer to a wide variety of gaming machines in addition to traditional free standing gaming machines. Such other gaming machines can include kiosks, set-top boxes for use with televisions in hotel rooms and elsewhere, and many server based systems that permit players to log in and play remotely, such as at a personal computer, personal digital assistant, cellular telephone or tablet computer, among other possible devices. All such gaming machines can be considered "gaming machines" for embodiments described herein.

Figure 2:
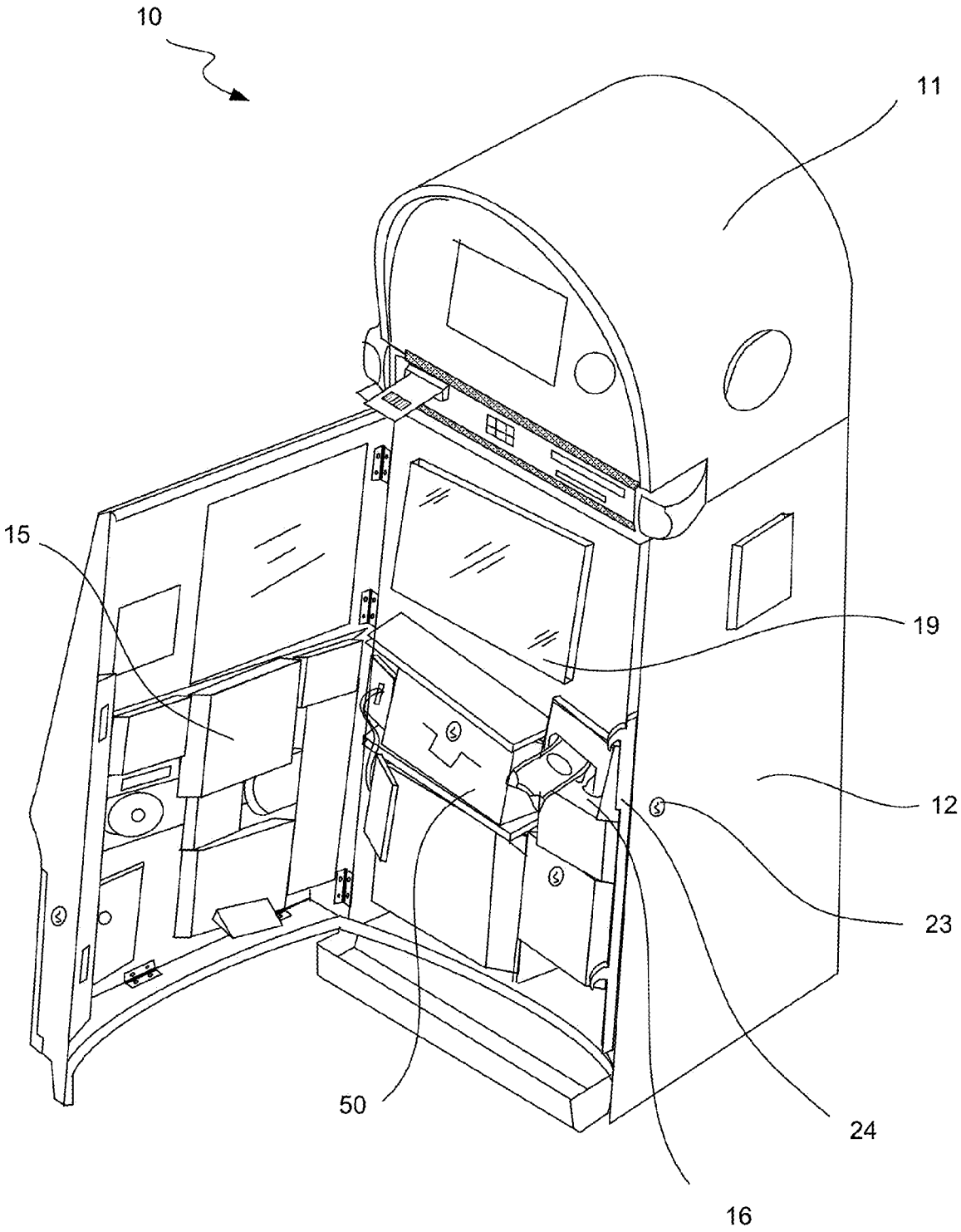
FIG. 2 illustrates in front perspective view an exemplary gaming machine adapted for mobile device data tracking with its main door opened according to one embodiment of the present invention.

Continuing with FIG. 2, an exemplary gaming machine is illustrated in front perspective view with its main door opened. In additional to the various exterior items described above, such as top box 11, main cabinet 12 and primary display 19, gaming machine 10 also comprises a variety of internal components. As will be readily understood by those skilled in the art, gaming machine 10 can include a variety of locks and mechanisms, such as main door lock 23 and an associated latch 24. Internal portions of coin acceptor 15 and bill or ticket scanner 16 can also be seen, along with the physical meters associated with these peripheral devices. Processing system 50 can include gaming machine computer architecture, which can be secured away within a restricted region inside the gaming machine, as will be readily appreciated.

When a person wishes to play a gaming machine 10, he or she provides coins, cash, tickets or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a display. Usually, during the course of a game, a player is required to make a number of decisions that affect the outcome of the game. The player makes these choices using a set of player-input switches. A game ends with the gaming machine providing an outcome to the person, typically using one or more of the displays.

After the player has completed interaction with the gaming machine, the player may receive a portable credit device from the machine that includes any credit resulting from interaction with the gaming machine. By way of example, the portable credit device may be a ticket having a dollar or other monetary value produced by a printer within the gaming machine. A record of the credit value of the device may be stored in a memory device provided on a gaming machine network (e.g., a memory device associated with validation terminal and/or processing system in the network). Any credit on some devices may be used for further games on other networked gaming machines 10. Alternatively, the player may redeem the device at a designated cashier, change booth or pay machine.

Gaming machine 10 can be used to play any primary game, bonus game, progressive or other type of game. Other wagering games can enable a player to cause different events to occur based upon how hard the player pushes on a touch screen. Gaming machine 10 can also enable a player to view information and graphics generated on one display screen while playing a game that is generated on another display screen. Such information and graphics can include game paytables, game-related information, entertaining graphics, background, history or game theme-related information, or information not related to the game, such as advertisements. The gaming machine can display this information and graphics adjacent to a game, underneath or behind a game or on top of a game. For example, a gaming machine could display paylines on a proximate display screen and also display a reel game on a distal display screen, and the paylines could fade in and fade out periodically.

Figure 3:
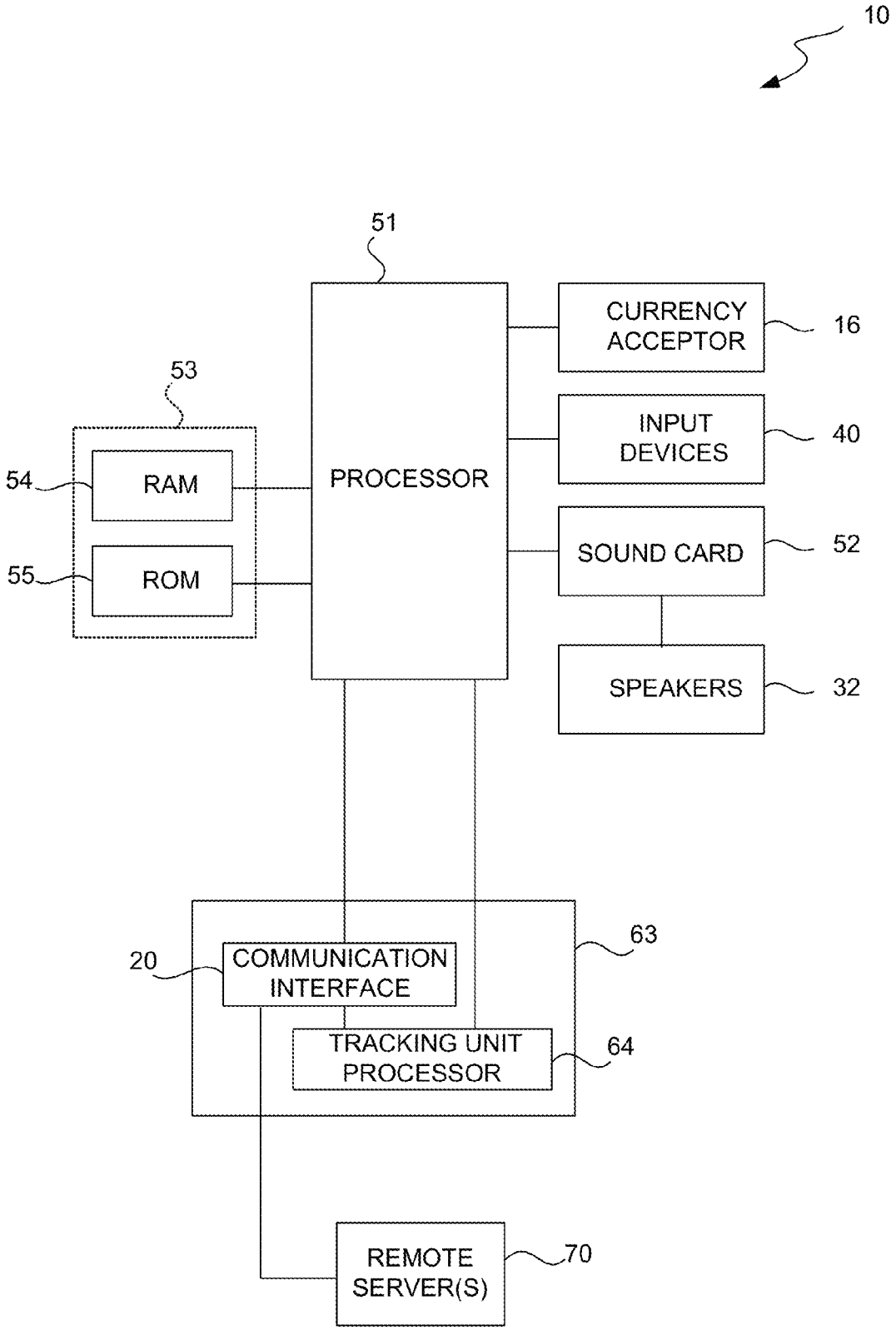
FIG. 3 illustrates in block diagram format an exemplary control configuration for use in a processor based gaming machine adapted for mobile device data tracking according to one embodiment of the present invention.

An electronic gaming machine can also include one or more processors and memory or other storage components that cooperate to output games and gaming interaction functions from stored memory. To this extent, FIG. 3 illustrates a block diagram of an exemplary control configuration for use in a processor based gaming machine 10. Primary processor or processing system 51 can be a microprocessor or microcontroller-based platform that includes one or more commercially available microprocessors provided by a variety of vendors known to those of skill in the art. Processor or processing system 51 can be a master gaming controller ("MGC") that is responsible for game determination and monetary accounting functions, among various other gaming machine functions. MGC 51 can be in communication with a mobile device tracking or communications unit 63 that is adapted to detect the presence of various third party mobile devices in the vicinity of the gaming machine. This mobile device interface 63 can include a dedicated tracking unit processor 64 that is coupled to a communication interface 20. Communication interface 20 may also be in communication with MGC 51, and is preferably also in communication with one or more remotely operating servers 70, so as to transmit security event related data to the remote server(s) for tracking and analysis purposes.

Gaming machine 10 may also include one or more application-specific integrated circuits ("ASICs") or other hardwired devices. One or more dedicated memory or storage components 53 may include one or more memory modules, flash memory or another type of conventional memory that stores executable programs that are used by the processing system to control various gaming machine components. Memory 53 can include any suitable software and/or hardware structure for storing data, including a tape, CD-ROM, floppy disk, hard disk or any other optical, magnetic or other non-volatile storage media. Memory 53 may also include a) random access memory ("RAM") 54 for storing event data or other data generated or used during a particular game and b) read only memory ("ROM") 55 for storing program code that controls functions on the gaming machine such as playing a game. Although the processor 51 and memory devices 53 can reside the gaming machine itself 10, it is possible to provide some or all of their functions at a central location such as a network server for communication to a playing station such as over a local area network ("LAN"), wide area network ("WAN"), Internet connection, microwave link, and the like.

In various embodiments, a player can use one or more input devices 40, such as a pull arm, play button, bet button or cash out button to input signals into the gaming machine 10. One or more of these functions could also be employed on a touch screen. In such embodiments, the gaming machine 10 can include a touch screen controller that communicates with a video controller or processor 51. A player can input signals into the gaming machine by touching the appropriate locations on the touch screen. Processor 51 also communicates with and/or controls other elements of gaming machine 10. For example, this includes providing audio data to sound card 52, which then provides audio signals to speakers 32 for audio output. Various commercially available sound cards and speakers are suitable for use with gaming machine 10. Alternatively, or in addition, various forms of embedded sound or other audio hardware or electronics solutions may also be used. Processor 51 can also be connected to a currency acceptor 16 such as the coin slot or bill acceptor. Processor 51 can operate instructions that require a player to deposit a certain amount of money in order to start the game.

Although the processing system shown in FIG. 3 is one specific processing system, it is by no means the only processing system architecture on which embodiments described herein can be implemented. Regardless of the processing system configuration, it may employ one or more memories or memory modules configured to store program instructions for gaming machine network operations and operations associated with layered display systems described herein. Such memory or memories may also be configured to store player interactions, player interaction information, and other instructions related to steps described herein, instructions for one or more games played on the gaming machine, and so forth.

Because such information and program instructions may be employed to implement the systems/methods described herein, the present invention relates to machine-readable media that include program instructions, state information, and the like for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as ROM, RAM, flash and other non-volatile storage media. Examples of program instructions include both machine code, such as produced by a compiler, and files containing higher-level code that may be executed by the computer using an interpreter.

The processing system may offer any type of primary game, bonus round game or other game. In one embodiment, a gaming machine permits a player to play two or more games on two or more display screens at the same time or at different times. For example, a player can play two related games on two display screens simultaneously. In another example, once a player deposits currency to initiate the gaming device, the gaming machine allows a person to choose from one or more games to play on different display screens. In yet another example, the gaming device can include a multi-level bonus scheme that allows a player to advance to different bonus rounds that are displayed and played on different display screens.

In various embodiments, gaming machine 10 can utilize a "state" machine architecture. In such a "state" machine architecture, critical information in each state is identified and queued for storage to a persistent memory. The architecture does not advance to the next state from a current state until all the critical information that is queued for storage for the current state is stored to the persistent memory. Thus, if an error condition occurs between two states, such as a power failure, the gaming device implementing the state machine can likely be restored to its last state prior to the occurrence of the error condition using the critical information associated with its last state stored in the persistent memory. This feature is often called a "roll back" of the gaming machine or device. Examples of critical information can include, but are not limited to, an outcome determined for a wager-based game, a wager amount made on the wager-based game, an award amount associated with the outcome, credits available on the gaming device, and a deposit of credits to the gaming device.

In various embodiments, gaming machine 10 can also include one or more secondary controllers (not shown). Such secondary controllers can be associated with various peripheral devices coupled to the gaming machine, such as value input devices and value output devices. As another example, one or more of such secondary controllers can be associated with peripheral devices, such as input devices, video displays, electro-mechanical displays, and a player tracking unit, among other possibilities. In some embodiments, a secondary controller can receive instructions and/or data from and provide responses to the MGC or primary processor 51. The secondary controller can be configured to interpret the instructions and/or data from the MGC, and also to control a particular device according to the received instructions and/or data. Additional such controllers may also be possible.

In some embodiments, a secondary controller can be used to control a number of peripheral devices independently of primary processor 51. For instance, a player tracking unit can include one or more of a video display, a touch screen, card reader, network interface, input buttons and the like. A player tracking controller can serve as a secondary controller to control these devices, such as to provide player tracking services and bonusing on gaming machine 10. Alternatively, the primary processor 51 can control these devices to perform player tracking functions. An advantage of performing player tracking functions via a secondary controller, such as a player tracking controller, is software on the player tracking unit can be developed and modified via a less lengthy and regulatory intensive process than is required for software executed by the primary processor 51. In general, certain functions of the gaming machine that are not subject to as much regulatory scrutiny as the primary wager-based game play functions can be decoupled from the primary processor 51 and implemented on a secondary controller instead. An advantage of this approach, such as for a player tracking controller, is that software approval process for the software executed by the secondary controller can be relatively less intensive.

Figure 4:
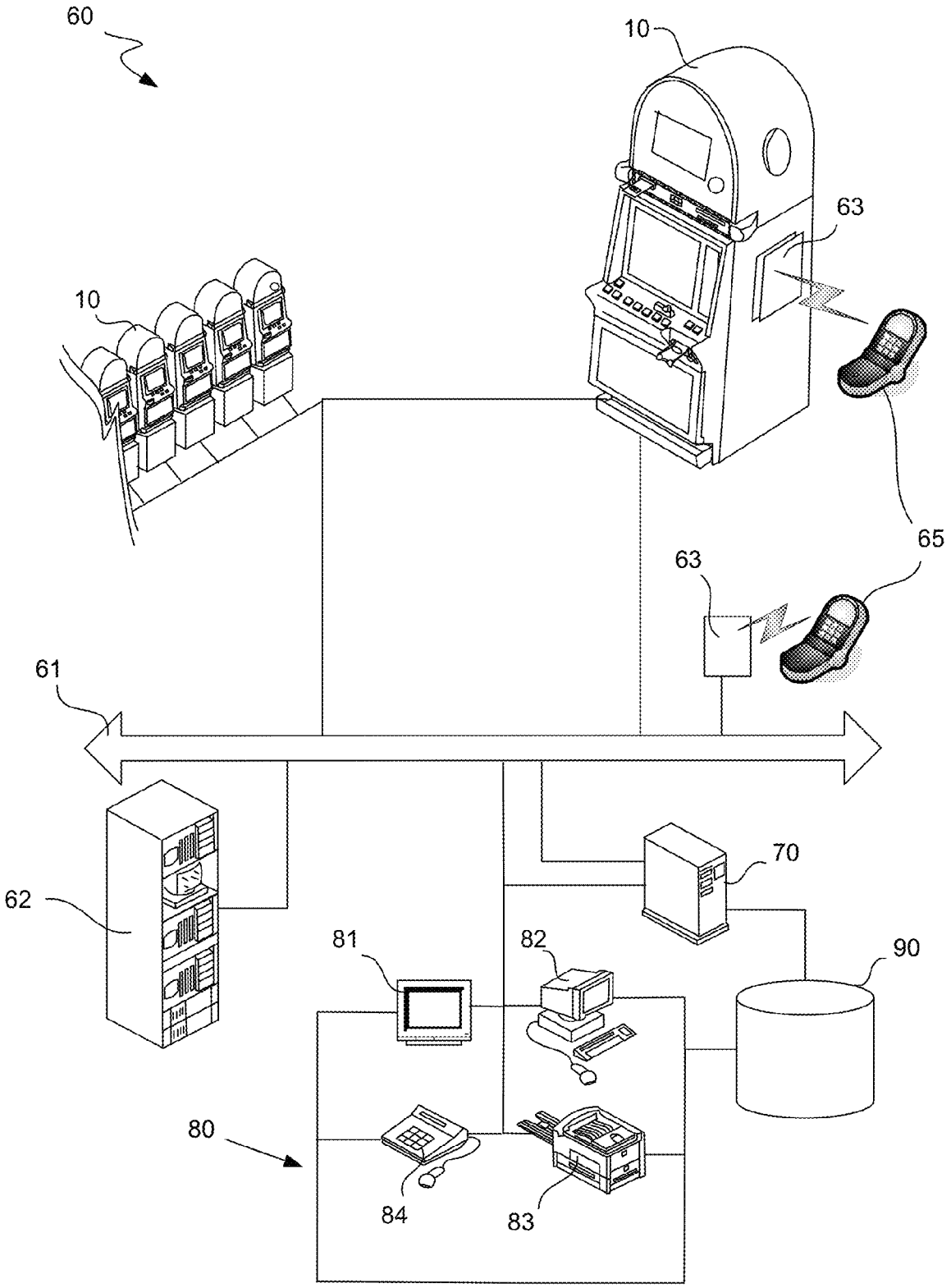
FIG. 4 illustrates in block diagram format an exemplary network infrastructure for providing a gaming system having one or more gaming machines adapted for mobile device data tracking according to one embodiment of the present invention.

Continuing with FIG. 4, an exemplary network infrastructure for providing a gaming system having one or more gaming machines is illustrated in block diagram format. Exemplary gaming system 60 has one or more gaming machines, various communication items, and a number of host-side components and devices adapted for use within a gaming environment. As shown, one or more gaming machines 10 adapted for use in gaming system 60 can be in a plurality of locations, such as in banks on a casino floor or standing alone at a smaller non-gaming establishment, as desired. A common bus 61 can connect one or more gaming machines or devices to a number of networked devices on the gaming system 60, such as, for example, a general-purpose server 62, one or more special-purpose servers 70, a sub-network of peripheral devices 80, and/or a database 90. Additional system devices (not shown) can include table gaming devices associated with table games where a live operator or a virtual operator is employed, and also mobile gaming devices, which may be owned by the gaming establishment and/or players themselves. The network can include wired, wireless or a combination of wired and wireless communication connections and associated communication routers.

In various embodiments, a mobile device interface 63 can be provided for detecting and/or communicating with a mobile device 65, such as a pager, PDA, smart phone, tablet computer or other wireless communications device carried by players, casino personnel or any other person at or proximate the gaming environment. As shown, such mobile device interfaces 63 can be located directly on one or more gaming machines 10, and/or may located elsewhere about the gaming floor. A wireless communication protocol, such as Bluetooth™ and a Wi-Fi compatible standard, can be used for communicating with or merely detecting various mobile devices 65 via mobile device interfaces 63. Alternatively, or in addition, the mobile device interface can implement a short range communication protocol, such as a near-field communication ("NFC") protocol typically used for mobile wallet applications. NFC is typically used for communication distances of 4 cm or less. Other non-limiting examples can include WiMax, 3G/4G LTE phone specifications, CDMA, GPRS, GPS, Bluetooth 4.0, wireless HDMI and the like. In addition, a wired communication interface, such as a docking station, can be integrated into the gaming machine. Such a wired communication interface can be configured to provide communications between the gaming machine 10 and the mobile device 65, and/or may provide power to the mobile device, such as to recharge a mobile device battery.

A general-purpose server 62 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 60 contains one or more special-purpose servers 70 that can be used for various functions relating to tracking and analyzing data regarding mobile devices associated with various security events. Such a special-purpose server or servers 70 could also include, for example, a cashless gaming server, a player verification server, a player tracking server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 60 can be isolated from any other network at the establishment, such that a general-purpose server 62 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 70 or another similar component within a general-purpose server 62 also preferably includes a connection to a database or other suitable storage medium 90. Database 90 is preferably adapted to store many or all files containing pertinent data or information for a particular purpose, such as, for example, data regarding mobile devices associated with various security events, among other potential items. Files, data and other information on database 90 can be stored for backup purposes, and are preferably accessible at one or more system locations, such as at a general-purpose server 62, a special purpose server 70 and/or a cashier station or other sub-network location 80, as desired.

While gaming system 60 can be a system that is specially designed and created new for use in a casino or gaming establishment, it is also possible that many items in this system can be taken or adopted from an existing gaming system. For example, gaming system 60 could represent an existing cashless gaming system or player tracking system, to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 90, specialized server 70 and/or general-purpose server 62, as desired. Other modifications to an existing system may also be necessary, as might be readily appreciated.

Security Event Data Tracking

As will be readily appreciated, a gaming establishment or other operator of an EGM or other gaming equipment has the ability to perform and also detect a wide variety of different security events. For example, an EGM operator can open the main door and various internal doors, turn security switches, access the coin and bill drops, and use menus to configure the machine, among numerous other events. While many of these types of security events are typically controlled and monitored well by the gaming operator or employees thereof, there always exists the potential for compromised activities by operator personnel or otherwise completely unauthorized breaches of EGM security. As noted above, while traditional surveillance cameras and other security protocols tend to work well, there can be room for improved detection and tracking of data associated with gaming based security events.

Such improved detection, tracking and analysis of data can rely upon newly emerging abilities of EGMs and other casino devices to detect the presence of mobile devices. For example and as noted above, one or more EGMs and/or other mobile tracking devices in the vicinity of a security event can be adapted to detect the presence of any mobile device at a given time. When a security event happens, each EGM and tracking device in the system can detect all mobile devices within range and transmit data regarding each one to a remote server or host. This transmitted data can then be associated with the security event. The remote server or host can reference any other data that may be known with respect to those detected mobile devices, such that a determination can be made as to which employees of the casino or other known individuals were present or nearby at or about the time of the security event. The information can then be used to determine whether the security event happened in the absence of casino personnel, to determine what other persons might have been present or nearby, and to create a log or record for the security event.

In some embodiments, the server can use this information over a series of security events to detect theft, game cheating or other suspect activities. As the server records or logs data associated with mobile devices over a series of security events, such data can be used to establish a pattern of one or more particular mobile devices that are present for the same or similar types of security events. For example, a pattern of tracked activities may reveal that many suspicious door open events are associated with a particular mobile device, especially if that device is not from an employee. The system might then be adapted to flag the device, and therefore the person that would be carrying it, as suspicious and notify the security personnel. Further biometric identifiers, such as camera recordings or fingerprint detections, could be used to associate the suspect mobile device with a particular person. If a person is then actually caught cheating or stealing from or cheating an EGM or other casino property, then security or law enforcement could obtain the suspect mobile device and check it against the data records as evidence of other security events.

Figure 5:
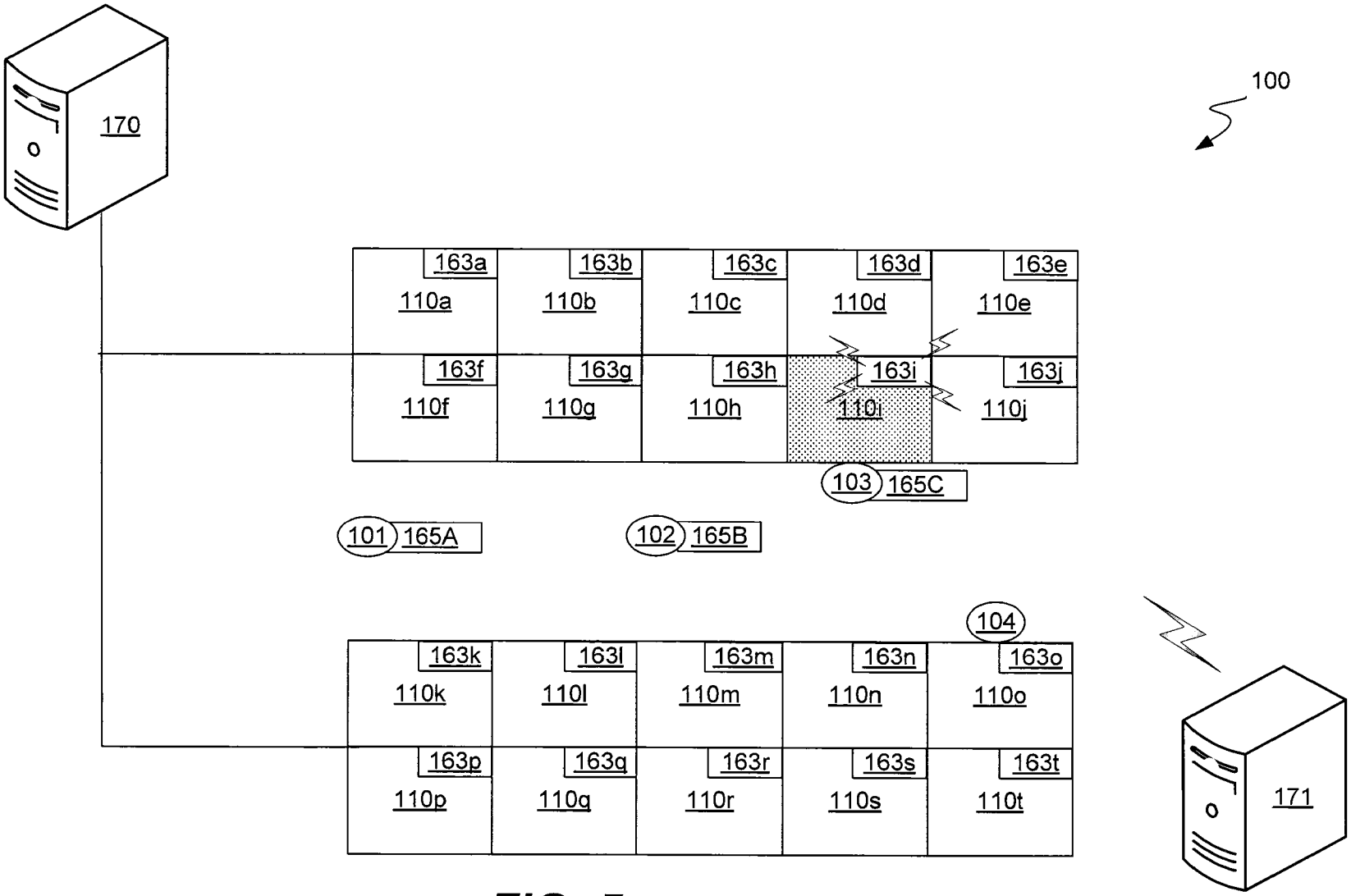
FIG. 5 illustrates in block diagram format an exemplary implementation of a specialized gaming system adapted for mobile device data tracking according to one embodiment of the present invention.

Turning now to FIG. 5, an exemplary implementation of at least a portion of a specialized gaming system adapted for mobile device data tracking is illustrated in block diagram format. Specialized gaming system 100 can include a plurality of gaming machines, 110*a* through 110*t*, each of which has a separate mobile device detector or interface, 163*a* through 163*t* respectively. Although twenty gaming machines 110 are shown as being arranged into two banks of ten machines each, it will be readily appreciated that more or fewer gaming machines may be present, that the machines may be arranged into more or fewer banks, and that not every gaming machine need have its own mobile device interface 163. Further, the EGMs 110*a*-110*t* can be in wireless or wired communication with one or more remote servers, such as server 170 and/or wireless server 171.

In general, specialized gaming system 100 may be adapted to detect, identify and associate wireless mobile devices with a variety of security events at a gaming machine or other gaming location of interest. For example, one or more players, bystanders, passersby, casino personnel and/or other individuals can include persons 101, 102, 103, each of whom may have a PDA, cell or smart phone, tablet computer, laptop, netbook, headset, media player, or other mobile device 165A, 165B, 165C respectively on or near his or her person while he or she plays or conducts other activities in or about the gaming environment. Of course, one or more persons 104 may not have such a mobile device on his or her person, as shown. A mobile device interface or detector 163 on a respective gaming machine 110 can be adapted to detect the presence of and identify one or more of such mobile devices 165. Again, such mobile device interfaces may also be located elsewhere about the gaming floor, in addition to at or about the EGMs themselves.

Each mobile device interface or detector 163 can involve the utilization of a wireless architecture, since many portable electronic devices support wireless communications. As will be readily appreciated, many wireless mobile devices have unique identifiers (e.g., a MAC address) or at least some form of identifier (e.g., make and model of Bluetooth™ headphones) that distinguishes the device from most other wireless mobile devices. Such identifiers can typically be read anonymously or "passively" by other wireless devices without any input from or indication to the owner or user of the wireless mobile device being read and identified. As such, the presence of a wireless mobile device on an anonymous player, bystander or other person in the gaming environment can be used to identify at least passively a particular person or carrier when detected.

Again, each mobile device interface or detector 163 can be configured to detect and/or communicate with the various mobile devices in proximity using any of a number of different communication protocols, depending on the capabilities of the mobile or portable electronic device. For instance, communications protocols, such as Bluetooth™, Wi-Fi™ and/or Near-Field Communication can be implemented on one or more of detectors 163. Other non-limiting examples can include WiMax, 3G/4G LTE phone specifications, CDMA, GPRS, GPS, Bluetooth 4.0, wireless HDMI and the like. When implemented, devices implementing the appropriate protocols can have different communication ranges. For instance, a class 2 Bluetooth™ device can have a range of about 10 meters or less, while a low power class 3 device can have a range of about 5 meters or less. Near-field communication enabled devices can have a range of about 4 cm or less. Indoors, depending on the obstructions and the version of Wi-Fi that is implemented, the range of a Wi-Fi enabled device can be about 50 meters. Further, a cellular communication range can be on the order of kilometers. The various mobile device interfaces or detectors 163 described herein can be enabled to simultaneously implement multiple wireless communication protocols and devices, as may be useful to facilitate detection of a wide variety of mobile devices.

In various embodiments, methods such as triangulation, signal strength determination and signal analysis can be used to determine an approximate location of a given mobile device within a casino or other gaming establishment. Such techniques can involve the use of multiple device interfaces or detectors, which can be on different EGMs and/or other locations about the gaming establishment. A location determination can be performed by a server, such as server 170 or 171, and/or one or more EGMs 110 to determine the locations of nearby portable electronic devices. Further, a number of wireless access points (not shown) can be provided in the area proximate to the banks of EGMs.

Again, the security event tracking server or servers 170, 171 can be in communication with the plurality of gaming machines 110*a*-110*t* and an associated database. Such a security event tracking server 170 can include at least a processor, a memory and a network interface to facilitate such functionality, as will be readily appreciated. At a minimum, the processor or processors on server 170 can be adapted to receive information regarding a security event and identifying information regarding one or more portable electronic devices from one or more of the various system gaming machines; associate the security event with the portable electronic device identifying information; and also store the associated security event and portable electronic device identifying information to the database. Additional functions that can be performed by server 170 are discussed below.

A plurality of receivers can be located within a casino environment for receiving wireless communication signals, such as: 1) the signals that cellular capable devices broadcast to cell phone towers, 2) the signals that Wi-Fi™ enabled devices broadcast, and/or 3) the signals that Bluetooth™ enabled devices broadcast. In general, wireless signals can be formatted according to many different types of communication protocols. Thus, different receivers configured to receive one or more different types of wireless signals and associated devices that process the wireless signals according to an associated wireless communication protocol can be utilized. It will also be readily appreciated that such wireless signals can be used to detect mobile devices that may be owned or controlled by the gaming establishment, as well as third party mobile devices that are owned or operated by players or other nonaffiliated persons. Such outsider mobile devices can be those that have been previously tracked or identified by the system, as well as unknown devices that have never before been detected or logged by the overall system.

In particular embodiments, wireless receivers of different types, i.e., configured to receive wireless signals in one or more different portions of the wireless spectrum can be incorporated into an EGM. A wireless receiver can be a separate component provided with the EGM or can be built in a device provided with the EGM, such as but not limited to a card reader, bill validator, a player tracking unit or a printer. Such a receiver can also be a separate dedicated device used for this specific purpose. In some instances, an EGM can include multiple wireless receivers. The data received from the various wireless receivers can be used to identify a mobile device, and may also be used to determine the location of the mobile device, such as by way of signal triangulation, for example.

In some embodiments, cellular data signals can be processed according to a cellular communication protocol, such as GSM or CDMA, to learn information about the device that is broadcasting the information. Such information can be that which allows the cellular enabled device to be identified as a unique node in a cellular network, for example. In some embodiments, one or more of the EGMs can include this capability, i.e., the ability to receive and process cellular data signals in a GSM or a CDMA format. Again, this information can also be utilized for determining device identification, location and tracking purposes. Further, the information can be used in association with a security event that occurs at or near where the device is located.

In some instances, a single device can be configured to broadcast multiple wireless communication protocols simultaneously. For example, a wireless device tracking system can be configured to detect a single device in different wireless spectrums simultaneously and perform location estimations, such as triangulation, based on the signals broadcast in the different wireless spectrums. For instance, a single smart phone can be configured to broadcast wireless signals in a cellular portion of the wireless spectrum and a Wi-Fi™ portion of the spectrum simultaneously. A wireless device tracking system can be configured to determine two estimates of its location using each of the two different types of wireless signals that have been received. In one embodiment, the system can be configured to determine which of the two different location estimates is more accurate and select the one determined more accurate for use. In another embodiment, the system can be configured to determine a single location estimate based upon each of the two location estimates. For instance, the two location estimates can be averaged together to provide the single location estimate.

Referring again to FIG. 5, person 103 having a portable electronic or mobile device 165C can be playing at gaming machine 110*i*. Should a security event happen at gaming machine 110*i*, such as person 103 hitting a jackpot, for example, then the existence of mobile device 165C can be detected by mobile device interface 163*i* at the gaming machine. In addition, the existence of other mobile devices 165A and 165B could also be detected by mobile device interface 163*i*. Again, such detections can be completely passive in nature, such that no interaction is required on behalf of any of the device owners or users. In addition, the existence of devices 165A, 165B, 165C can also be detected by one or more of the other mobile device interfaces 163*a*-163*t* in the vicinity of the security event that occurs at gaming machine 110*i*. In some embodiments, every one of the interfaces or detectors 163*a*-163*t* on gaming machines 110*a*-110*t* can be used to detect the presence of mobile devices in the area at or about the time of the security event. Thus, while a wireless signal may be blocked or weakened by a physical feature or set of circumstances with respect to a single mobile device interface or detector, it is unlikely that a given mobile device that is in the vicinity and able to communicate will be missed by all of the mobile device interfaces or detectors.

Again, the use of multiple interfaces or detectors 163*a*-163*t* can result in a thorough sweep of the area to detect all or most all of whatever mobile devices may be present, as well as to help establish the exact location of each device in some cases. As such, the instance of a security event can trigger the system to send out a ping from one, some or all of the interfaces 163*a*-163*t*, whereupon the device data that is returned results in establishing the existence and location of each of devices 165A, 165B and 165C at the time of the security event. This information or data can then be associated with the security event and logged into a database for future reference and possibly analysis involving trends over multiple events, for example.

In some embodiments a system ping to detect mobile devices can be sent out from one, some or all detector devices immediately upon the occurrence of a security event. In some embodiments, a system ping can be sent out at some time after the security event, which may be in addition to an initial ping at the time of the event. In still further embodiments, a system ping can be sent out at regular intervals to track mobile devices regardless of whether security events have occurred. Such information can be kept in an expansive recording database, or discarded in the event that no security event or other event of interest ever becomes associated with the information. In this manner, information regarding mobile devices that may have been present prior to a security event can be obtained.

In some instances, a given portable electronic device may be recognized as belonging to a particular person, such as an employee that is assigned a company owned device or a patron associated with a loyalty program. In other cases, a given mobile device can be unknown, and possibly never before seen by the system. In any event, the system can be configured to track the portable electronic device and store information about it with respect to a given security event. Other information related to a given device may also be stored as well. For instance, if a portable electronic device is determined to be located near an EGM for a period of time during which a game play session occurred, and the game play is associated with an anonymous or unidentified patron, the system can be configured to associate the game play activity to the portable electronic device as a proxy for the unidentified patron. Thus, when a portable electronic device is detected and it is determined not to be associated with a patron registered with a loyalty program, the system can be configured to store information about activities that have been associated with the identified portable electronic device. This information can be used to help identify owners of various devices and to establish patterns of behaviors for such noted owners.

The security event data tracking systems disclosed herein can also include, for example, various detecting devices that are able to detect passively individualized mobile device data and/or other biometrics for known or unknown individuals that or at or near a security event of interest. Passive detection of individual mobile devices and biometrics generally includes detection that does not involve any affirmative activity by the person. So while the affirmative use of a fingerprint detector typically involves an instruction to a person to place his or her finger in a selected location so that a fingerprint can be read, for example, a passive detection is one that is made during the routine activity of the person. Such passive detection may take place without the knowledge of the person being detected. For example, a mobile device carried by the person can be detected and its identifying data culled without any action or knowledge on behalf of its controller. Another common example involves the use of security cameras, which can capture and record information about people without any input from the people being detected. As yet another example, a person may press a gaming machine button to play a game or check other information, where the pressed button has a built-in fingerprint reader that detects the fingerprint. Further details regarding such passive fingerprint or other biometric detection are set forth at, for example, commonly owned U.S. patent application Ser. No. 13/306,911, filed Nov. 29, 2011, which is incorporated by reference herein for this purpose.

In still further embodiments, other personal biometrics can be passively measured and associated with a given mobile device where appropriate. Passive detection of such personal biometrics can include fingerprint detection, retinal scans, vein detection in palms or other body components, facial recognition, voice recognition, handwriting analysis, keyboard or other input styles and tendencies, eye pattern movements, shapes of fingers, hands or other body parts, thermal patterns, blood pressure and the like. Various suitable hardware devices and specialized software can be used for such alternative passive biometric tracking, such as cameras, microphones, associated software, and the like.

Figure 6:
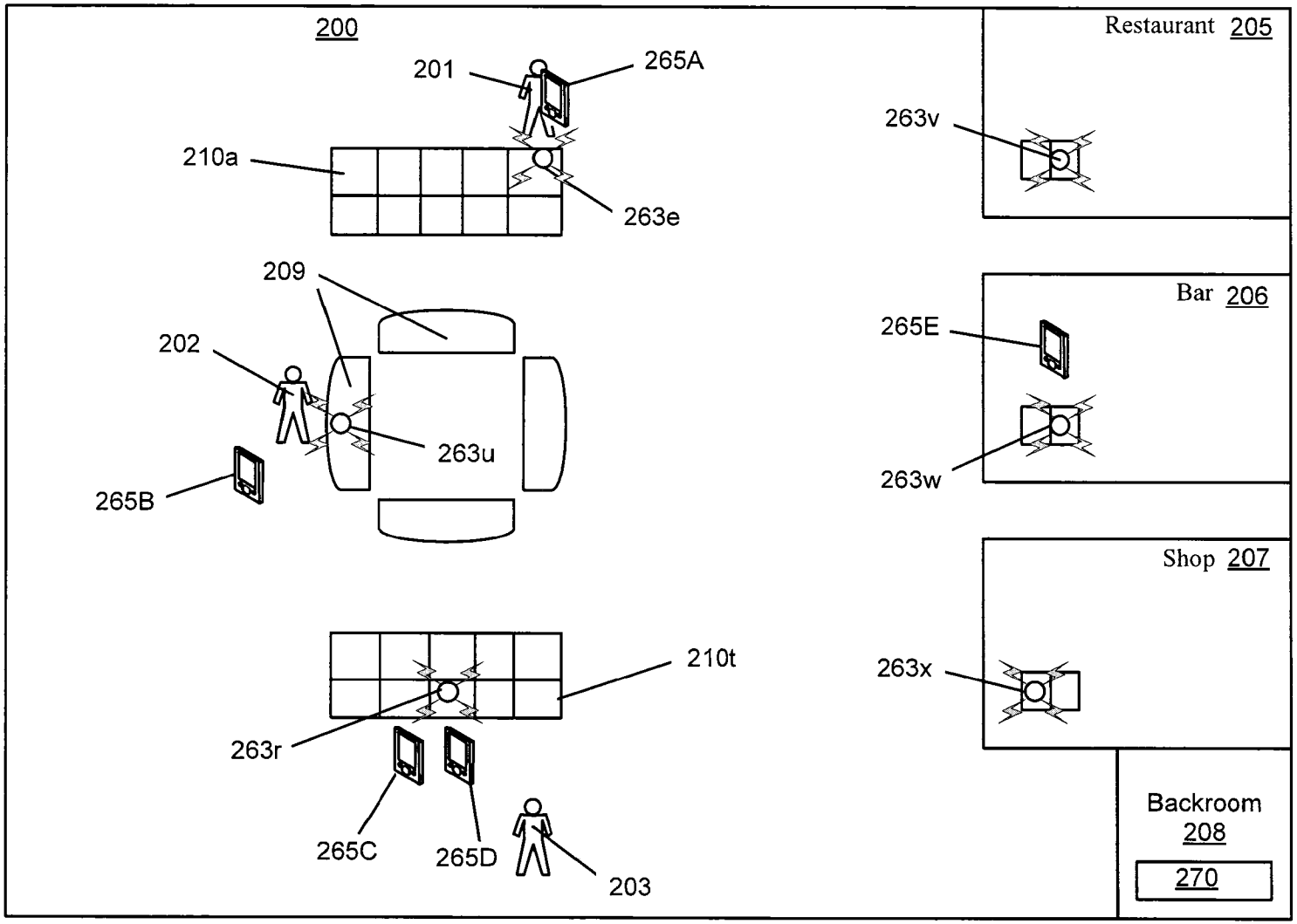
FIG. 6 illustrates in block diagram format another exemplary specialized gaming system for tracking data associated with security events according to one embodiment of the present invention.

Moving on to FIG. 6, another exemplary specialized gaming system is similarly shown in block diagram format, particularly with respect to tracking data associated with security events. Specialized gaming system 200 can be similar to system 100 above in that it includes a plurality of gaming machines 210*a*-210*t* arranged into two banks of ten machines each. Similar to the foregoing system 100, each gaming machine 210*a*-210*t* can have its own mobile device interface or detector 263, the functionality of which is set forth in greater detail above. Each gaming machine 210 and detector 263 is not labeled here again for purposes of simplicity and illustration. Additional gaming machines and detectors for same can be included, as will be readily appreciated. One or more system components can be adapted to communicate with a remote server 270 or other suitable host based application, which can be located remotely, such as in a back room of the establishment.

In addition to the gaming machines, one or more gaming tables 209 can also be present within gaming system 200, with one or more additional detectors such as detector 263*u* being at or near the gaming tables. Further, the establishment having system 200 can also include a number of other items or locations, such as a restaurant 205, a bar 206 and a shop 207, among others. Other similarly included items or locations not shown can include, for example, a hotel, a spa and/or a show venue, among numerous other possibilities. Each of these other items or locations 205, 206, 207 can include respective mobile device interfaces or detectors 263*v*, 263*w*, 263*x*, and it will be understood that more than one such interface or detector can be placed at each such location. These interfaces or detectors 263 can be placed strategically, such as incorporated with a cash register or other point of sale device.

Again, various persons 201, 202, 203 can be located about the gaming floor and/or elsewhere about the establishment when a security event takes place. Such persons can each be carrying one or more mobile devices 265A, 265B, 265C, 265D, and other mobile devices 265E may also be present and detectable despite not being carried by a person at a given time. For example, device 265E might be a phone that has been left behind, or it might be a scanner or other mobile device owned by the gaming operator that is on but not currently in use. Again, each of these mobile devices 265A-265E can be detected, at least partially identified and potentially located by any, some or all detectors 263*a*-265*x* at a particular time. Such a detection, identification and location determination can be had by way of a ping signal sent out by one or more of the interface devices 263, upon which data is returned by one or more of the mobile devices 265. This returned data can then be forwarded to server 270 for recording and future analysis.

The determination of whether to send out a ping signal from one or more interface devices 263 can be made locally at each device, or can be made from the server instructing the devices to do so. As noted above with respect to FIG. 3, each interface device can have a dedicated processor, which may provide instructions or a protocol on how and when to send out ping signals and collect and forward return data. Alternatively, local determinations can be made by the MGC 51 or other processor of a respective local device. Where such instructions are provided by a remote server, such as server 270, the particular protocols for sending out ping signals can be by a systematic overall design and/or in response to a security event that is detected and relayed to the remote server to be acted upon.

In other embodiments, the instruction to send out a ping signal for one or more interface devices 263 can come from another local interface device 263 or processor, such as a different MGC of another machine. For example, where a security event is triggered by person 201 and detected at the gaming machine having interface device 263*e*, this gaming machine or interface device 263*e* can not only send out its own ping signal to detect mobile devices in the vicinity, but it can also send out instructions for other interface devices in the neighborhood to also send out ping signals. Such a network configuration may result in faster response times and actions in contrast to requiring all detections to be routed through a remote server, which in turn sends out instructions for ping signals to all appropriate interface devices.

Of course, the detection of a security event may often result in the person responsible for triggering the detection being unknown. In such instances, the automated collection of data from numerous sources can be helpful in reconstructing the gaming floor or other environment at or about the time of the security event. While such automated collection of data can include video footage and other biometric identifiers where appropriate, detecting the existence of mobile devices at or near a security event can prove useful as well. Where a single mobile device is detected to the exclusion of all others, this may prove to be quite useful information, particularly where the owner of that device can eventually be determined. Often times, however, multiple devices will be detected when a system ping is sent.

When multiple wireless signal sources are detected for a single instance, then whether a given source is to be associated with a security event or other activity of interest might be determined based upon a relative distance of the location of the source to the activity relative to the location of the activity. If the source location is considered too far away, e.g., more than arms length or a few feet from an activity location, then in some embodiments, the source either might not be associated with the activity, or might have a lower confidence level of being associated with the security event or activity of interest. This distance can be referred to as a threshold distance. For instance, wireless signal source 265B may be determined to beyond a distant threshold from security event location 263*e*, such that it is not considered associated with the security event occurring at location 263*e*. In another example, a biometric signal source (e.g., an image of person 203 taken from a surveillance camera) may be determined to be too far away from the security event location 263*e* for that person to be associated with the security event.

Many times however, multiple sources of biometric and/or wireless signal data can be located in reasonable proximity to a given security event location. In many instances, when multiple biometric sources and/or wireless signal sources are located proximate to one another and activity location, it may not be clear 1) which source can be associated with the activity, 2) whether each of the sources is associated with a different individual, and 3) whether two or more of the sources are associated with the same individual. For instance, wireless sources 265C and 265D may both be determined to be associated with a particular security event near detector 263*r*, because they are both within a threshold distance from the activity. In such instances, other biometric or corroborating data from other sources may be used if available. Also, data regarding each such device can be recorded for future review and analysis.

For example, biometric data can be received multiple times such that the server 270 can determine that a particular person is associated with the security event or activity of interest. However, the server 270 may not be able to determine if a simultaneously detected wireless device is carried by the person that provided the biometric data or someone else that was simply nearby. If a time period can be determined for the security event, one method of making the determination of whether the wireless device is to be associated with the activity can be if the wireless device was in the vicinity of the activity for a similar time period. Another method of making the determination can be to check video surveillance data to see whether a single or multiple people are in the vicinity of the gaming device during the time frame of the security event. Yet another method can involve determining whether the wireless device signal data is repeatedly detected when the biometric data is detected.

Wireless data sources can be associated with a wide variety of security events and other activities of interest. For instance, if a security event is detected in a particular area, then the system can be configured to determine if any wireless data can be associated with the security event. The system can be configured to store a record of the security event and any associated wireless data. In future events, the system can be configured to determine whether there is a pattern of certain wireless signal data being detected when security events are detected. If a pattern is detected, then this wireless data could be used to determine possible suspects associated with the security event.

Figure 7:
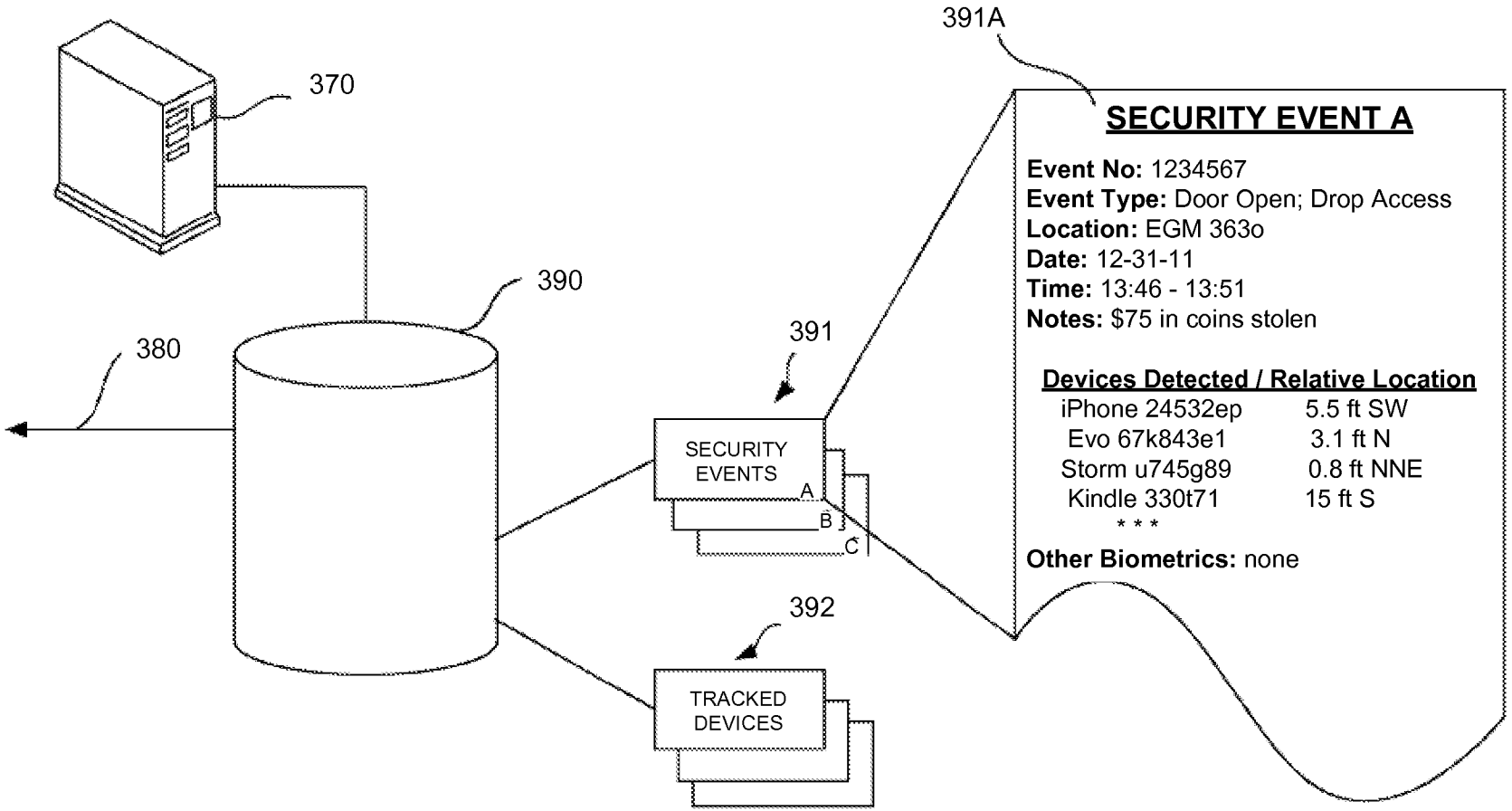
FIG. 7 illustrates in block diagram format an exemplary security event data tracking profile according to one embodiment of the present invention.

Turning now to FIG. 7, an exemplary security event data tracking profile according to one embodiment of the present invention is disclosed. Again, a special purpose server 370 adapted for tracking, recording and analyzing data regarding mobile devices associated with various security events can be coupled to a specialized security event database 390. Database 390 can in turn be coupled to one or more further system components by way of connection 380. This database 390 can hold a plurality of records, such as security event records 391 and tracked device records 392, among other possible record types. Security event records 391 can include a plurality of records, logs or files relating to different security events. Each such security event record 391 can include data regarding a specific security event, with such data including a log of all mobile devices that were noticed and associated with the event. Tracked device records 392 can include a plurality of records, logs or files relating to different tracked mobile devices. Each such tracked device record 392 can include data with respect to a single noted mobile device, with such data including some or all of the security events that have been linked to that device.

As one illustrative example, security event record 391A can contain a variety of information regarding a break-in at a particular gaming machine. Each separate security event can have data similarly logged in its own separate record or file on database 390. Pertinent information or data for each file or record, such as exemplary record 391A, can include an assigned event number or identifier, an event type, a location, date, time, notes, detected mobile devices and relative locations, and also other biometric identifiers noticed, if any. In the particular example given, the location is electronic gaming machine number 363*o*, with the event being a door open and a money drop access. Notes can include remarks that are manually entered by casino personnel, for example. Four mobile devices were detected in close proximity to the gaming machine at the time of the security event, as noted in the record 391A. Other mobile devices not shown may also be recorded to the event record 391A, as may be suitable for the levels of detail desired by a given system operator.

In addition to keeping database records that are specific to particular security event files 391 or particular tracked device files 392, other forms of data tracking can also take place on database 390. For example, and as noted above, the overall system can be configured such that the system mobile device interfaces or detectors send out pings to cull mobile device information at regular intervals, regardless of the occurrence of a security event. Such regular intervals can be, for example, every ten minutes, every minute, every fifteen seconds, or every second, as may be desired by a given operator having sufficient storage space or processing abilities for all such data. In this manner, a "snapshot" of many or all mobile devices and their respective locations on the gaming floor can be recorded at periodic intervals. This data can then be used in conjunction with data relating to security events to provide a more robust picture of mobile device presence and movement before, during and after a security event or series of security events.

As one non-limiting illustrative example, a floor configuration can include a plurality of mobile device interfaces 263*a*-263*x*, each of which is configured to ping for mobile device data and collect such data every five seconds. This information can be used to track the locations and movements of virtually any mobile device on or about the gaming floor, so long as such a device is in a typical active communication mode. When a security event occurs at a particular EGM, gaming table, or shop, the database and server can be used to provide information regarding the existence, location and movements of many or all mobile devices at or near that security event, and at all times before, during and after the event. Such data could be useful even in isolation with respect to a single security event.

In some embodiments, data can be tracked, recorded and analyzed with respect to numerous security events, so as to establish patterns of mobile device presence with respect to certain kinds of security events. For example, it may be noticed over a period of time that many or all machine tamperings or thefts of a particular type tend to occur with the same unknown third party mobile device in the vicinity of the affected machines. In such a situation, the system could be adapted to raise a security flag with respect to the particular mobile device of interest. When such a device is again detected on the gaming floor, further action can be made with respect to the individual carrying the device. Such further action can be in the form of positively identifying the individual for future reference, heightened scrutiny or surveillance of the individual, or even questioning or arrest depending upon the circumstances and nature of the recorded events.

While security events can include things such as opened doors, turned security switches and monetary drop access, virtually any and all other types of events can be categorized as a security event. A non-limiting list of other types of security events can include, for example, device tilts, other machine malfunctions, power downs, machine reconfigurations, any maintenance work, game downloads, game selection changes, cash ins, cash outs, ticket-ins, ticket-outs, jackpot wins, wins of any amount, bonus wins, player tracking events, and designated amounts of time, among numerous other possibilities. In addition, an EGM and overall security system can be adapted to be updatable such that uninteresting security event types can be dropped, and such that new events of interest can be added as tracked security events as well. In this manner, a given gaming operator can have a customized spread of security events that are tracked for a gaming establishment.

Methods

Figure 8:
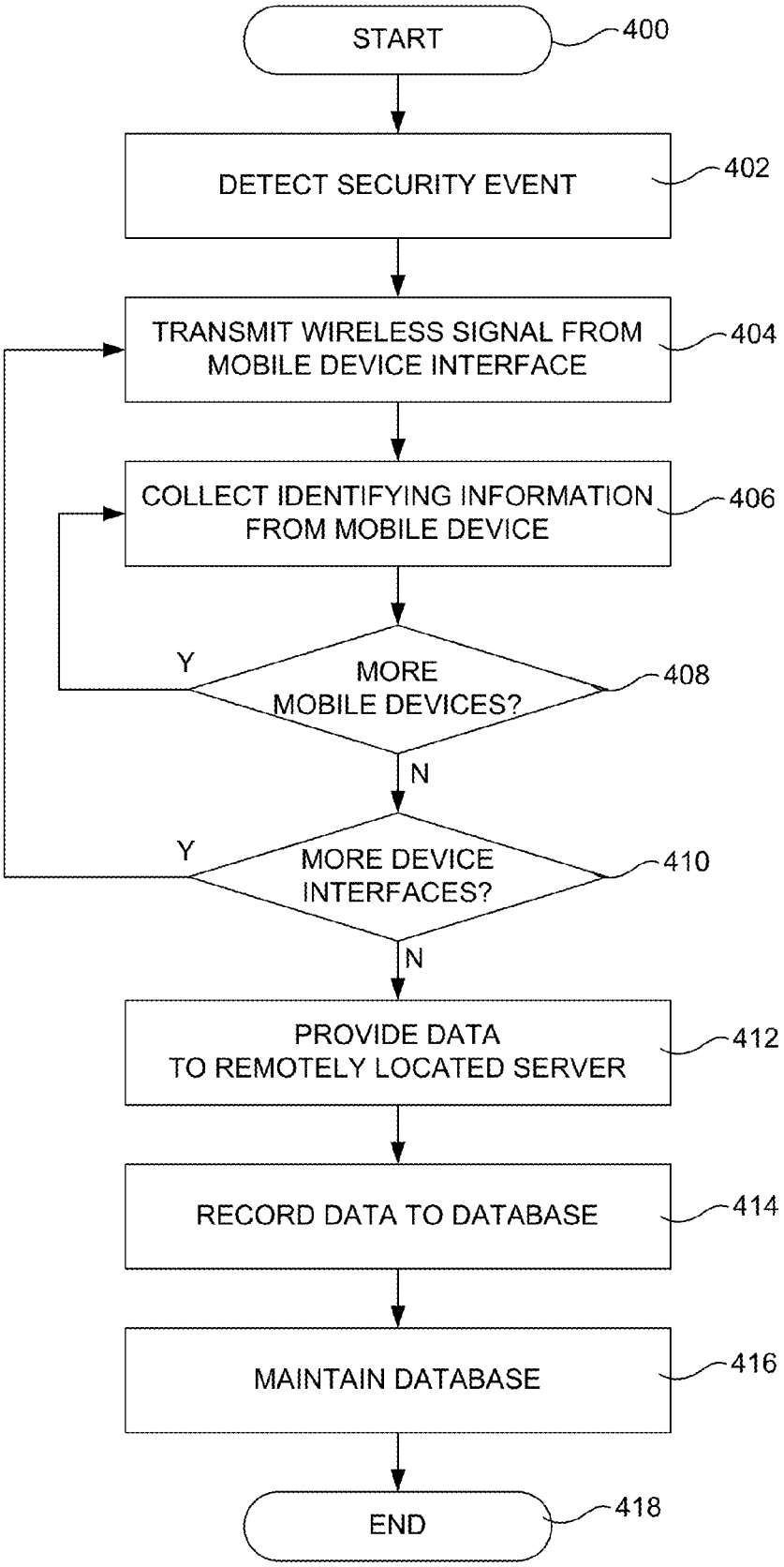
FIG. 8 provides a flowchart of an exemplary method of tracking data associated with a security event according to one embodiment of the present invention.

Moving lastly to FIG. 8, a flowchart of an exemplary method of tracking data associated with security events according to one embodiment of the present invention is provided. It will be understood that the provided steps are shown only for purposes of illustration, and that many other or different steps may be included in the process, as may be desired. Furthermore, the order of steps may be changed where appropriate and not all steps need be performed in various instances. For example, the order of steps 408 and 410 may be reversed, while steps 402 and/or 416 may be performed at several different points in the process. Other differences may also be possible, and it will be readily appreciated that the described steps and order are not limiting in any way.

After a start step 400, an initial process step 402 involves detecting a security event. Again, such a security event can be any of a wide variety of events, and detection of such an event can actually occur later in the process in some embodiments. For example, where wireless ping signals are to be transmitted periodically, these steps can be performed before, simultaneously with, and/or after the detection step 402. A wireless signal is transmitted from a mobile device interface or detector at process step 404, after which mobile device identifying information is collected at process step 406. Again, the mobile device interface can be located at an EGM, for example. Alternatively, or in addition, a mobile device interface can be located at other places, such as at a gaming table, at a point of purchase, or even standing alone on a wall or ceiling of the establishment.

At subsequent decision step 408, an inquiry is made as to whether more mobile devices are present. If so, then the method reverts to step 406, where identifying information is then collected for another mobile device. This process can be repeated until information is collected by the mobile device interface for all mobile devices that are present. An inquiry is then made at decision step 410 as to whether there are more mobile device interfaces that can collect information. If so, then the method reverts to step 404, whereupon steps 404 through 408 are repeated for the next mobile device interface. This process can also be repeated until all mobile device interfaces that are to be involved have collected data from all mobile devices that are present.

As will be readily appreciated, steps 404 through 410 need not be performed serially in iterative fashion as shown. In fact, it is specifically contemplated that these steps can be performed simultaneously for each mobile device and for each mobile device interface that is present. Once the identifying information is collected for all mobile devices at all mobile device interfaces, the method then continues to process step 412, where this data is then provided to the remotely located server or other suitable host based application, as may be appropriate. The data is recorded to the database at process step 414, and the database is maintained at process step 416. Further analysis of the data may also be performed as may be desired (not shown). The method then ends at end step 418.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A system adapted to facilitate the tracking of information related to security events in a gaming environment, comprising:

a plurality of gaming machines, each having a master gaming controller adapted to execute or control one or more aspects of a wager-based game, a communication interface adapted to facilitate communications between the gaming machine and an external remote server, and an electronic tracking device adapted to detect wirelessly identifying information from one or more portable electronic devices proximate to the gaming machine with respect to the occurrence of a security event at or near the gaming machine;

a database adapted to store a plurality of informational files regarding security events and detected portable electronic devices associated therewith that are detected by said plurality of gaming machines; and a security event tracking server in communication with the plurality of gaming machines and the database, said security event tracking server including a processor, a memory and a network interface, wherein the processor is configured to:

receive information regarding a security event and identifying information regarding one or more portable electronic devices from one or more of said plurality of gaming machines, associate the security event with the portable electronic device identifying information, and store the associated security event and portable electronic device identifying information to the database.

2. The system of claim 1, wherein the processor is further configured to provide commands to one or more of the plurality of gaming machines to transmit a wireless signal to determine the presence of one or more portable electronic devices.

3. The system of claim 2, wherein the processor provides said commands in response to receiving a notice of the existence of a security event.

4. The system of claim 2, wherein the processor provides said commands at regular period intervals regardless of the existence of a security event.

5. The system of claim 1, wherein the processor is further configured to utilize passively detected identifying information regarding one or more portable electronic devices from a plurality of gaming machines to establish the actual relative locations of each of the one or more portable electronic devices at a given time.

6. The system of claim 1, wherein the processor is further configured to detect repeat instances of the same portable electronic device in association with different security events.

7. The system of claim 6, wherein the processor is further configured to provide an alert with respect to said same portable electronic device when the number of repeat instances reaches a threshold value.

8. The system of claim 1, wherein the portable electronic device identifying information is detected passively without any affirmative input by any user of the one or more portable electronic devices.

9. The system of claim 1, wherein said security event is selected from the group consisting of: opened door, turned security switch, monetary drop access, device tilt, power down, machine reconfiguration, maintenance work, game download, game selection change, ticket-in, ticket-out, jackpot win, and player tracking event.

10. The system of claim 1, wherein said one or more portable electronic devices are selected from the group consisting of: PDA, cell phone, tablet computer, laptop, netbook, headset, and media player.

11. A method of tracking data regarding security events involving processor-based gaming machines adapted for accepting monetary wagers, playing games based on the wagers and granting payouts based on the results of the wager-based games, the method comprising:

detecting the existence of a first security event at or near a first processor-based gaming machine;

transmitting a wireless signal from the first processor-based gaming machine;

collecting identifying information wirelessly from a first portable electronic device at the first processor-based gaming machine in response to said transmitted signal, wherein said collecting is performed passively without any affirmative input by the user of the first portable electronic device;

providing data regarding the first security event and the identifying information for the first portable electronic device from the first processor-based gaming machine to a remotely located server; and recording said data in a manner that associates the first security event with the identifying information for the first portable electronic device.

12. The method of claim 11, further including the step of:

maintaining a database of recorded information that includes a plurality of known security events and a plurality of detected portable electronic devices associated with said known security events.

13. The method of claim 11, further including the steps of:

collecting identifying information wirelessly from a second separate portable electronic device at the first processor-based gaming machine in response to said transmitted signal, wherein said collecting is performed passively without any affirmative input by the user of the second portable electronic device, wherein said step of providing data includes also providing data for the second portable electronic device, and wherein said step of recording includes also associating the first security event with the identifying information for the second portable electronic device.

14. The method of claim 11, wherein said step of transmitting is performed in response to said step of detecting.

15. The method of claim 11, wherein said step of transmitting is performed at periodic intervals regardless of the existence of a security event.

16. The method of claim 11, wherein each of the recited steps are repeated for the occurrence of a separate second security event.

17. The method of claim 11, further comprising the steps of:

transmitting a wireless signal from a second processor-based gaming machine that is near said first processor-based gaming machine;

collecting identifying information wirelessly from the first portable electronic device at the second processor-based gaming machine in response to the signal transmitted therefrom, wherein said collecting is performed passively without any affirmative input by the user of the first portable electronic device; and providing data regarding the first security event and the identifying information for the first portable electronic device from the second processor-based gaming machine to the remotely located server.

18. A processor-based gaming machine adapted for accepting a monetary wager, playing a game based on the wager and granting a payout based on the result of the wager-based game, the gaming machine comprising:

an exterior housing arranged to contain a plurality of internal gaming machine components therein;

a master gaming controller in communication with at least one of said plurality of internal gaming machine components and adapted to execute or control one or more aspects of said wager-based game;

a communication interface adapted to facilitate communications between the gaming machine and an external remote server; and an electronic tracking device in communication with the remote server via said communication interface, wherein said electronic tracking device is adapted to detect wirelessly identifying information from one or more portable electronic devices proximate to the gaming machine with respect to the occurrence of a security event at or near the gaming machine.

19. The gaming machine of claim 18, wherein said gaming machine is adapted to provide data to the remote server regarding the security event and the identifying information for all detected portable electronic devices.

20. The gaming machine of claim 18, wherein the portable electronic device identifying information is detected passively without any affirmative input by any user of the one or more portable electronic devices.

* * * * *